US005309811A

United States Patent [19]

Hoshino

[11] Patent Number: 5,309,811

[45] Date of Patent: May 10, 1994

[54] SUPPORT STRUCTURE FOR A DRUM

[75] Inventor: Yoshiki Hoshino, Aichi, Japan

[73] Assignee: Hoshino Gakki Co., Ltd., Japan

[21] Appl. No.: 900,415

[22] Filed: Jun. 18, 1992

[30] Foreign Application Priority Data

Nov. 1, 1991 [JP] Japan ..... 3-315334

[51] Int. Cl.[5] ..... G10D 13/02

[52] U.S. Cl. ..... 84/421; 248/220.2; 248/316.8

[58] Field of Search ..... 84/421, 411 M, 411 R, 84/413; 248/220.2, 225.2, 231.7, 316.8, 443

[56] References Cited

U.S. PATENT DOCUMENTS

| | | | |
|---|---|---|---|
| 994,289 | 6/1911 | Unger | 84/421 |
| 1,022,149 | 4/1912 | Maphet | 84/421 |
| 4,334,458 | 6/1982 | Grauso | 84/411 R |
| 4,448,105 | 5/1984 | Cordes | 84/411 R |

FOREIGN PATENT DOCUMENTS

| | | |
|---|---|---|
| 0194834 | 4/1986 | European Pat. Off. . |
| 3830445 | 4/1989 | Fed. Rep. of Germany . |
| 2052827 | 1/1981 | United Kingdom . |
| 2210723 | 6/1989 | United Kingdom . |

*Primary Examiner*—Michael L. Gellner
*Assistant Examiner*—P. Stanzione
*Attorney, Agent, or Firm*—Ostrolenk, Faber, Gerb & Soffen

[57] ABSTRACT

A support structure for a musical instrument drum. From each of the top and bottom drum hoops, a respective installation part projects radially. A support plate extends between and is attached to both installation parts. A bracket on the plate receives a support rod from a drum support. This arrangement keeps the weight burden of the drum off the drum body and applies it only to the end hoops.

13 Claims, 8 Drawing Sheets

SUPPORT STRUCTURE FOR A DRUM

BACKGROUND OF THE INVENTION

The present invention relates to a support structure for a musical instrument drum, capable of supporting the drum without obstructing its production of sound.

A prior art support structure for a medium drum, called a tom-tom, is shown in FIG. 8. A medium drum 70 has a drum body 71. A respective set of drum lugs 73 is installed toward each axial end of the drum body and the drum hoops at each drum head are bolted to the respective set of lugs. A drum body support bracket 72 is installed at the vertical center of the drum body. The bracket is attached to a drum support stand 75 by a bolt 76 that extends through a drum support rod 74 supported at the stand 75. The rod 74 is inserted through a receiving opening in the bracket 72. Although the support structure using the bracket 72 has a comparatively simple structure, the entire weight of the drum is carried on the bracket 72. This places the weight burden on the localized part of the drum body 71 on which the bracket 72 is installed during a long period of use of the drum. Eventually, this produces strains in the drum body 71 in some cases. This in turn causes the drum body to lose its original resonant function, thereby changing and perhaps diminishing the quality of the sound produced by the drum body due to drum beating.

SUMMARY OF THE INVENTION

The object of the invention is to overcome the aforementioned problem.

Another object is to provide a drum support structure that will place no weight burden on the drum body even after a long period of use of the drum.

The support structure for a drum according to the invention includes a support plate which is installed through respective installation parts that have been provided on each of the top hoop and the bottom hoop of the drum. A bracket for receiving the drum support rod from the stand is provided on the support plate. This arrangement holds the burden of the weight of the drum off one side of the drum body and away from its midsection, as in the prior art, and instead applies that burden to the drum hoops around the end regions of the drum body.

Other objects and features of the present invention will become apparent from the following description of the invention which refers to the accompanying drawings.

DESCRIPTION OF THE PREFERRED EMBODIMENTS

Figure 1:
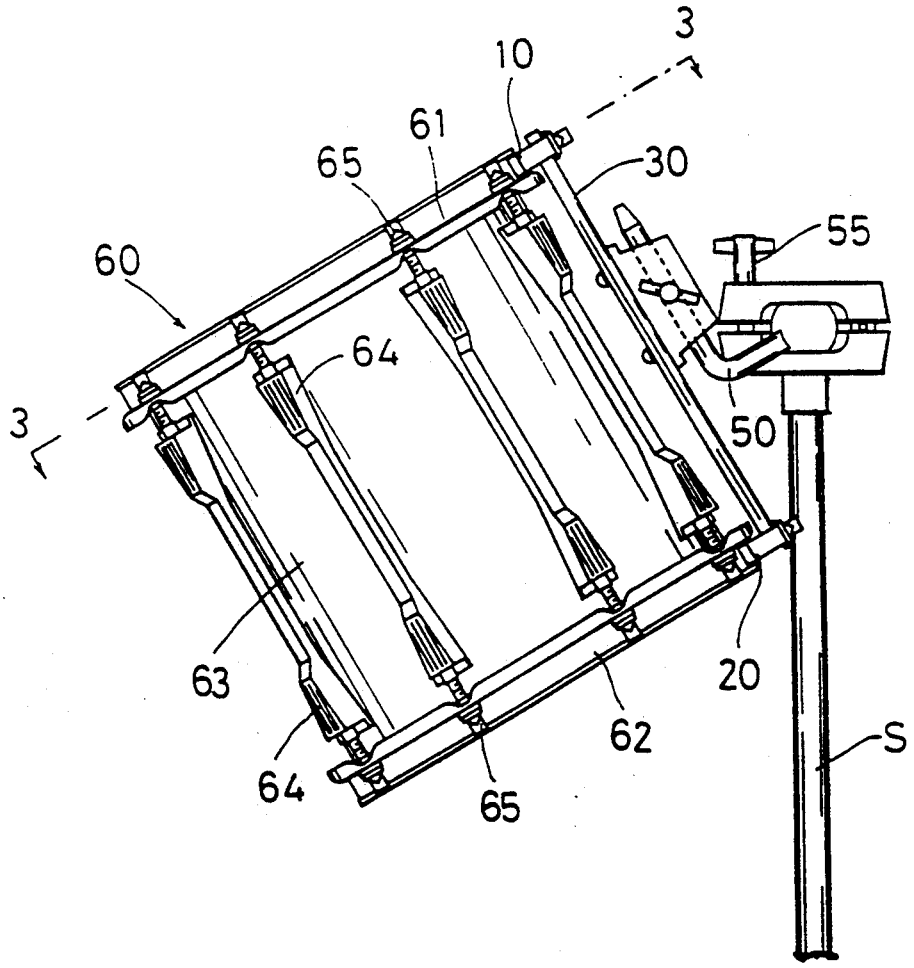
FIG. 1 shows a front view of a medium size drum supported by a drum support structure according to a first embodiment of the invention.
Figure 2:
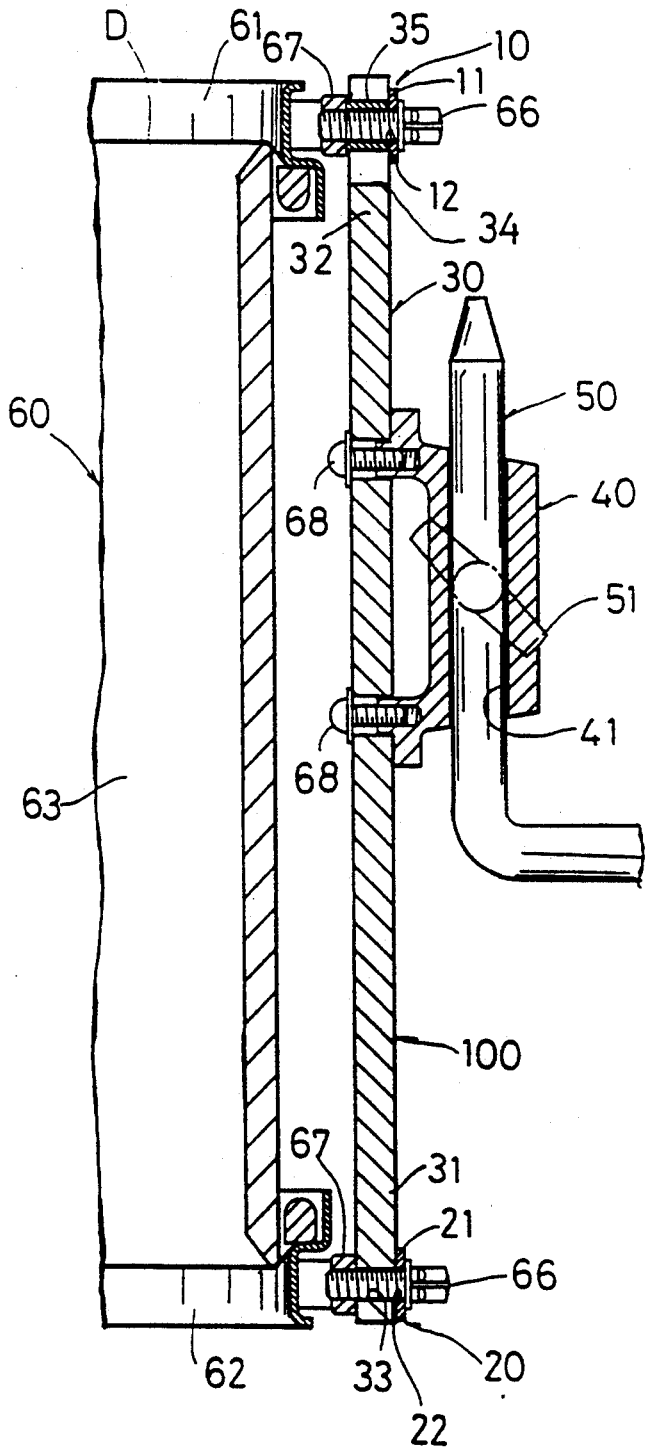
FIG. 2 is a vertical section through essential parts of the drum support structure according to the invention.
Figure 3:
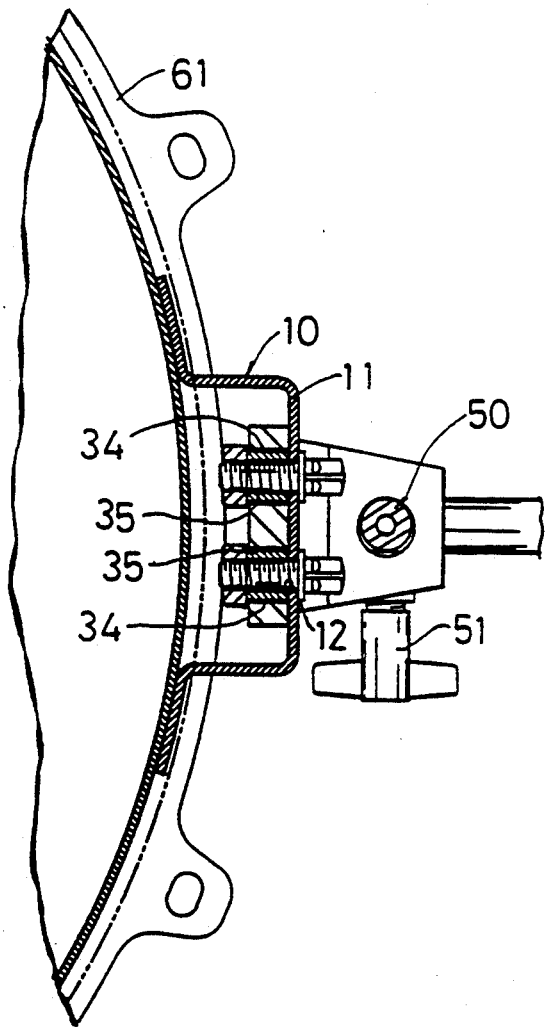
FIG. 3 is a transverse cross section through the essential parts and along line 3—3 in FIG. 1.

Referring to FIGS. 1 and 2, respective drum support bracket installation parts 10 and 20 are formed on and are illustrated as projecting radially from the top end hoop 61 and the bottom end hoop 62, respectively, of a musical instrument drum 60. The drum is a medium size, two headed drum, such as a tom-tom. A support plate 30 extends the height between and is installed through the installation parts 10 and 20.

A drum body support bracket 40 is installed by two bolts 68 on the support plate 30. The drum 60 is firmly fixed to the stand S by means of a drum support rod 50 that extends from the stand S and is inserted into a vertically extending opening through the bracket 40.

The drum body 63 carries respective sets of lugs 64 at the top and bottom sides in which a drum head and drum hoop tightening bolt 65 is received and tightened in a conventional manner.

Figure 4:
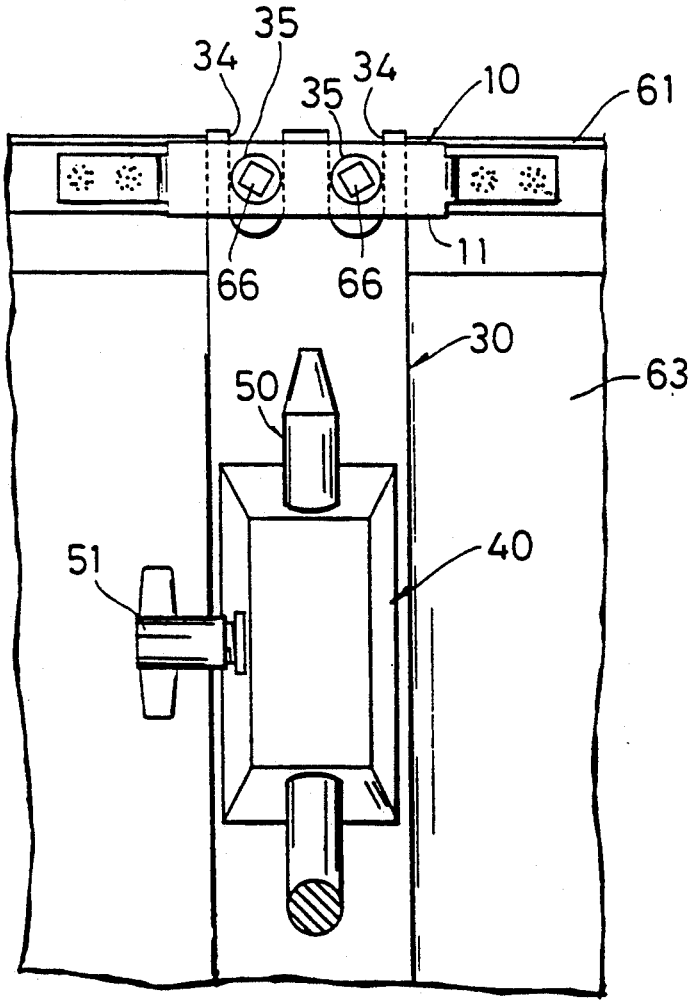
FIG. 4 is a right-side view showing the essential parts in FIG. 1.

As shown in FIGS. 2 and 4, the drum support bracket installation parts 10 and 20 comprise respective hangers 11 and 21 which are fixed by spot welding to and project out from the top side hoop 61 and the bottom side hoop 62, respectively. The hangers have respective installation holes 12 and 22 for respective support plate installation bolts 66. The installation parts 10 and 20 may alternatively be formed integrally with the respective drum hoops.

The support plate 30 has a screw hole 33 at its lower portion. The plate is compressively fixed to the installation part 20 that has been provided on the bottom side drum hoop 62 by means of a support plate installation bolt 66 which has a nut 67 on it.

There is a cut 34 in from the top 32 of the plate 30 along which the collar 35 of the support plate upper tightening bolt 66 can slide. This enables exchanging the drum head D and enables adjustment of the drum head tension without having to remove the drum 60 from the stand S. As a result, tightening of the support plate tightening bolt 66 may secure only the installation part 10 of the top side hoop 61, without fixing the support plate 30 to the installation part 10.

A vertically extending rod insertion hole 41 extends through the bracket 40. The drum support rod 50 from the stand S is inserted into the hole 41. The drum 60 is fixed at a desired drum height using the drum support rod tightening screw 51.

As in the case of the installation parts 10 and 20, further, the support plate 30 and the bracket 40 on the plate can be formed integrally as a die cast product.

Since the support plate 30 and the bracket 40 for fixing the drum are not fixed to the drum body 63, but are instead attached to the hoops at the ends of the drum body, the weight of the drum 60 is not applied to the side of the drum body, avoiding any weight burden being placed on the drum body.

Figure 5:
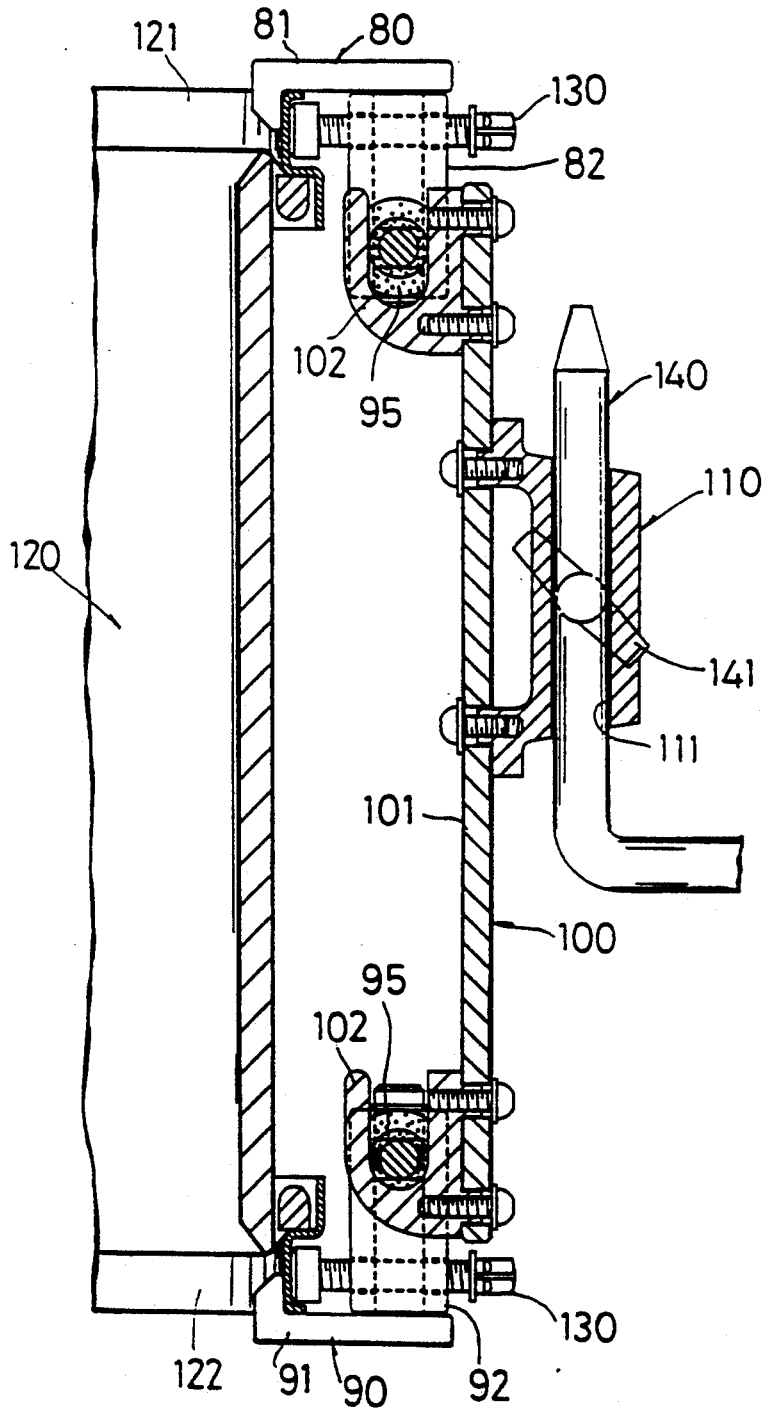
FIG. 5 is a vertical section through the essential parts of another embodiment of the invention.
Figure 6:
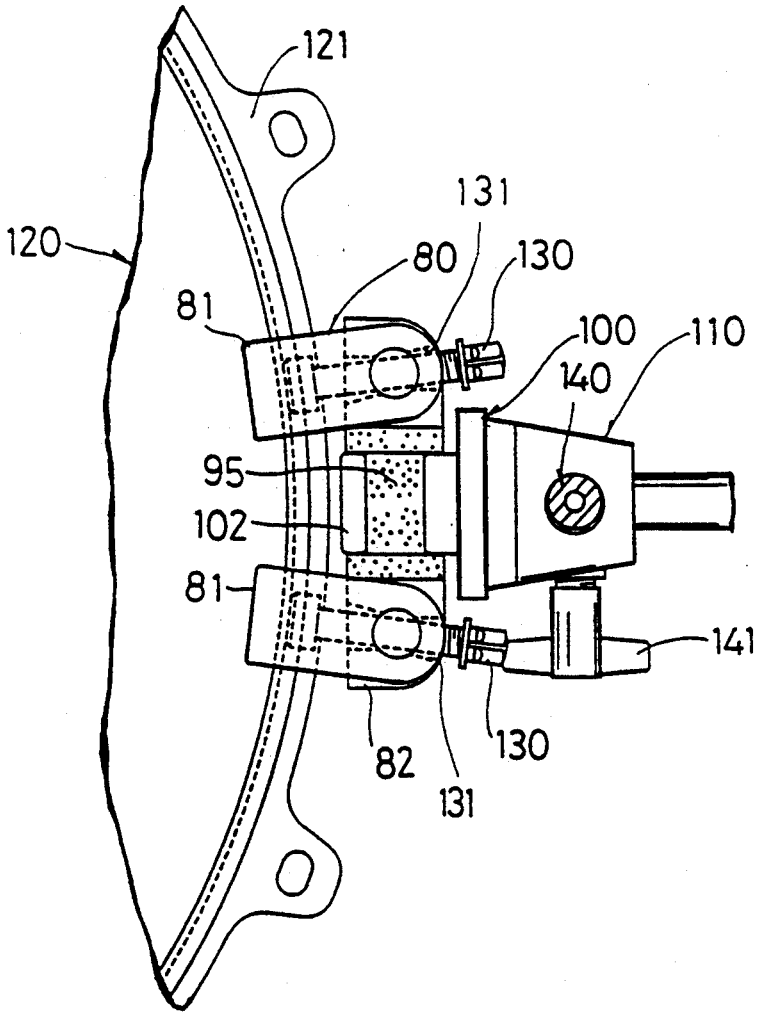
FIG. 6 is a plan view of the essential parts of the second embodiment showing the state in which the drum has been removed.
Figure 7:
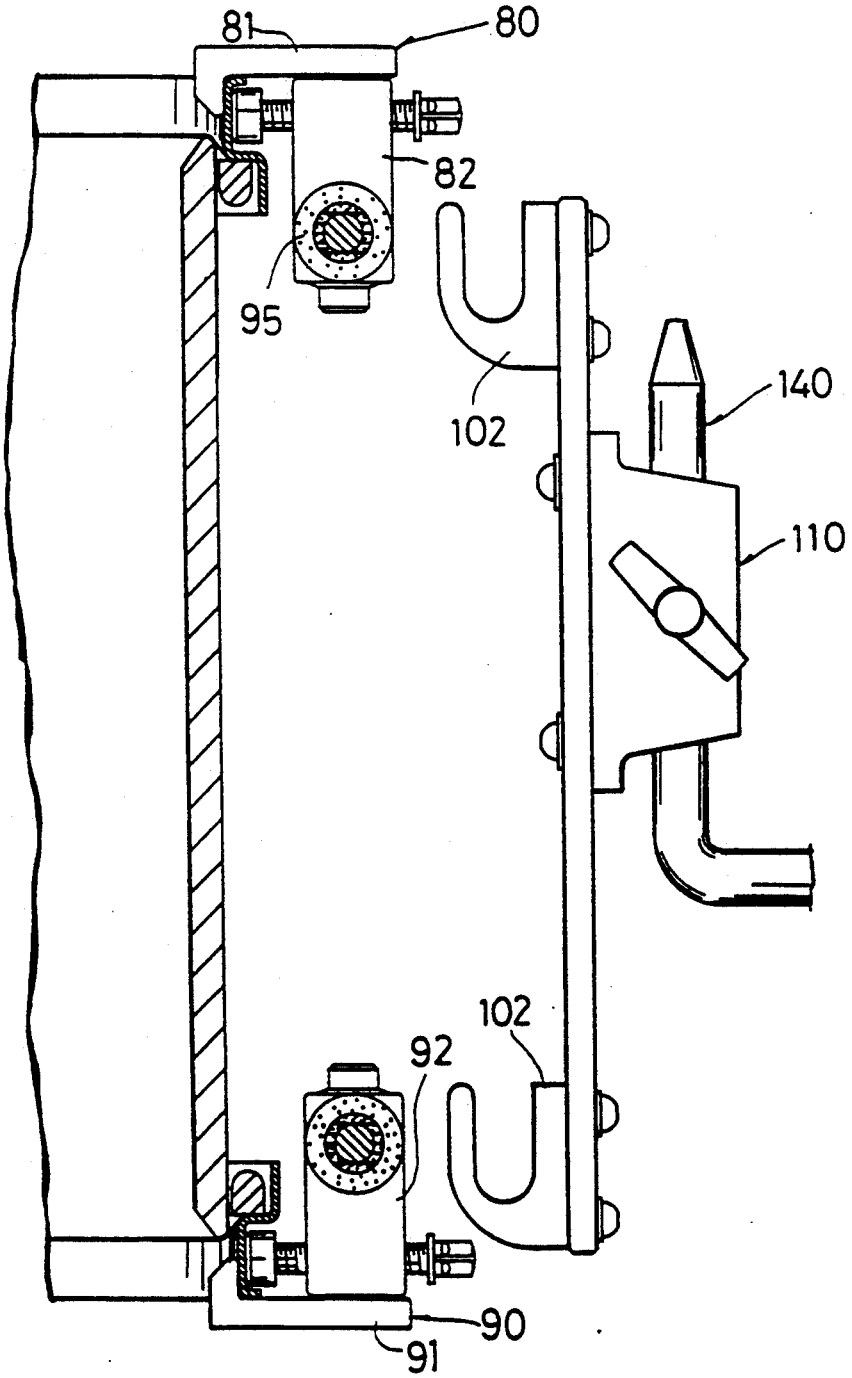
FIG. 7 is a cross section of the parts shown in FIG. 6.
Figure 8:
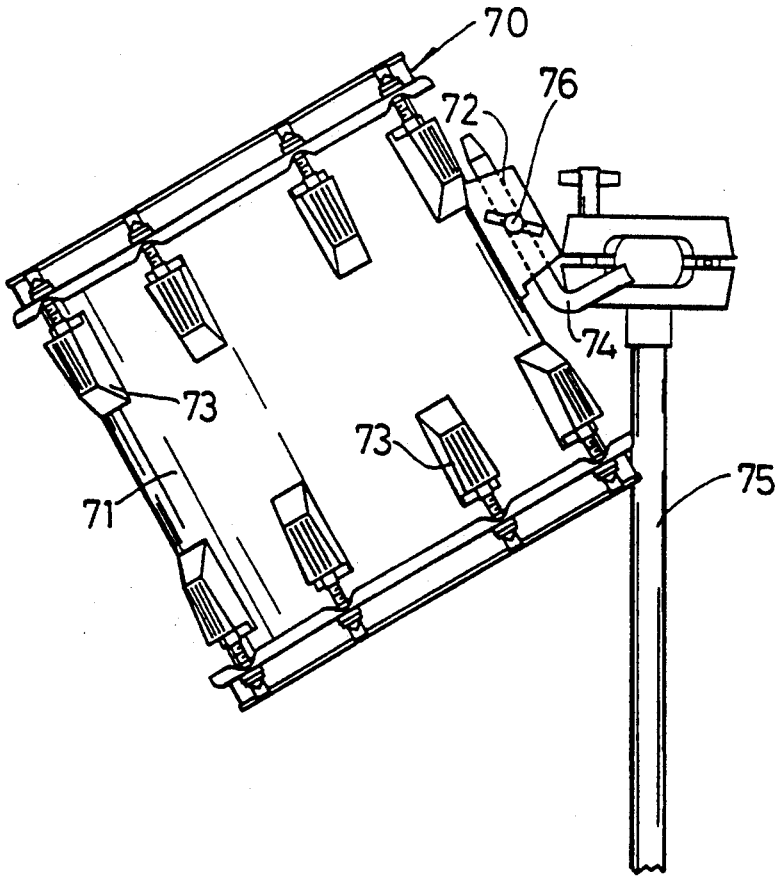
FIG. 8 PRIOR ART
FIG. 8 is a side view of a prior art drum support structure.

FIGS. 5 through 7 show another embodiment of the invention. It includes upper and lower installation parts 80 and 90, a support plate 100 to one side of the drum for supporting the drum body, a bracket 110 on the plate 100 and a drum 120. The installation parts 80 and 90 are comprised of hoop clamps 81 and 91 which have been installed on the top side hoop 121 and on the bottom side hoop 122, respectively, of the drum 120. The hoop clamps 81 and 91 are equipped with respective support plate engaging parts 82 and 92 and are installed on the respective hoops by means of fixing screws 130.

An elastic body 95 comprised of urethane or rubber, etc. absorbs vibrations, to prevent the vibrations due to the beating of the drum from being transmitted to the support plate 100 and to the stand S so that satisfactory sound quality can be obtained from the drum.

As seen in FIG. 6, the hole 131 for insertion of the fixing screw 130 of the hoop clamps 81 and 91 has a large diameter at the engaging part but has a small diameter at the center in the support plate engaging parts 82 and 92. As a result, the clamps 81 and 91 rotate along with the fixing screw 130, making it possible for the clamps to cope with large or small diameter hoops.

The support plate 100 is comprised of a main support body 101 and respective hooks 102 installed at both ends of the said main support body 101. A drum support bracket 110 is installed generally at the center along the plate 100.

An insertion hole 111 extends vertically through the bracket 110. A drum support rod 140 is inserted into the hole 111. The drum is fixed at a desired height position as the drum support rod 140 is tightened by a drum support rod tightening bolt 141.

According to the above described structure, the drum 120 can be installed, simply and firmly, without using a bolt, etc. by merely causing the hook 102 of the support plate 100 to be engaged with the support plate engaging parts 82 and 92 of the installation parts 80 and 90.

Since the drum body is secured in position only by the upper and lower drum hoops according to the invention, no weight burden should be placed upon the drum body. Instead, the weight burden is applied to the drum hoops which encircle the drum body near its top and bottom ends. As a result, excellent sound quality can be achieved at all times without obstructing the resonance effect of the drum.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A support structure for a musical instrument drum, wherein the drum includes: a drum body with a top end and a bottom end; a top drum hoop extending around the drum body toward the top end, a bottom drum hoop extending around the drum body toward the bottom end;

the support structure comprising:

an upper installation part at a top hoop of a drum, a lower installation part at a bottom hoop of the drum; the upper and lower installation parts being fixed to the top hoop and the bottom hoop, respectively, so as to project radially therefrom;

a support plate extending between and attached to the upper and lower installation parts and the support plate being otherwise out of supporting engagement with a drum body of the drum, whereby the support plate supports the drum body via the installation parts;

a bracket on the support plate for receiving a drum support by which the bracket and thereby the drum is supported on the drum support, wherein each of the installation parts extends away from the drum body in the same direction, and means separably attaching the support plate to the installation parts, the attaching means enables positioning of the installation parts an adjustable distance apart for enabling drum hoop position adjustment.

2. The support structure of claim 1, wherein the bracket has an opening therein; the drum support comprising a rod extending into the bracket opening.

3. The support structure according to claim 2, wherein the bracket includes means for adjusting the position of the bracket on the drum support so as to set the drum at a desired position relative to the drum support.

4. The support structure of claim 1, further comprising vibration absorbing means at the attaching means for absorbing vibration which otherwise might be transmitted to the support plate.

5. The support structure according to claim 1, wherein an upper end of the support plate as at least one elongated cut extending along the length of the support plate from a top edge thereof, and a lower end of the support plate has at least one hole;

the attaching means comprises at least two connectors, one connector securing the upper installation part to the upper end of the support plate by slidably engaging the elongated cut in the support plate, and a second connector securing the lower installation part to the lower end of the support plate by passing through the hole in the support plate; the slidably engagement of the elongated cut permitting the positioning of the installation parts an adjustable distance apart for enabling drum hoop position adjustment.

6. The support structure according to claim 1, wherein the respective installation parts are fixed by spot welding to the corresponding drum hoops.

7. The support structure according to claim 1, wherein the respective installation parts are formed integrally with the corresponding drum hoops.

8. The support structure according to claim 1, wherein the support plate and the bracket on the plate are integrally formed as a die cast product.

9. A support structure for a musical instrument drum, wherein the drum includes: a drum body with a top end and a bottom end; a top drum hoop extending around the drum body toward the top end, a bottom drum hoop extending around the drum body toward the bottom end;

the support structure comprising:

an upper installation part at a top hoop of a drum, a lower installation part at a bottom hoop of the drum; the upper and lower installation parts being fixed to the top hoop and the bottom hoop, respectively, so as to project radially therefrom;

a support plate extending between and attached to the upper and lower installation parts and the support plate being otherwise out of supporting engagement with a drum body of the drum, whereby the support plate supports the drum body via the installation parts;

a bracket on the support plate for receiving a drum support by which the bracket and thereby the drum is supported on the drum support, wherein each of the upper and lower installation parts includes:

a hoop clamp, the hoop clamp being fixed on the respective drum hoop so as to project radially therefrom;

a support plate engaging part attached to the hoop clamp, the support plate engaging part of the upper installation part extending downwardly and the support plate engaging part of the lower installation part extending upwardly; the respective support plate engaging parts having means for separably attaching the support plate to the respective installation parts; and a connector for fixing the hoop clamp to the respective drum hoop.

10. The support structure according to claim 9, wherein the support plate engaging part includes means for absorbing vibration from beating of the drum.

11. The support structure according to claim 9, wherein each of the upper and lower installation parts comprises two hoop clamps, two support plate engaging parts and two connectors, respectively.

12. The support structure according to claim 9, wherein an upper end and lower end of the support plate each have at least one hook-like part, the respective hook-like parts engaging the respective attaching means of the support plate engaging parts of the upper and lower installation parts so as to separably attach the support plate to the respective installation parts.

13. The support structure according to claim 9, wherein the hoop clamp is pivotable with respect to the corresponding support plate engaging part.

* * * * *